US006065932A

United States Patent [19]

Dodd

[11] Patent Number: 6,065,932

[45] Date of Patent: May 23, 2000

[54] TURBINE

[75] Inventor: Alec G Dodd, Derby, United Kingdom

[73] Assignee: Rolls-Royce plc, London, United Kingdom

[21] Appl. No.: 09/178,740

[22] Filed: Oct. 27, 1998

Related U.S. Application Data

[63] Continuation-in-part of application No. 08/891,500, Jul. 11, 1997, abandoned.

[51] Int. Cl.[7] ..... F01D 5/18; F01D 9/04

[52] U.S. Cl. ..... 416/97 R; 416/95; 416/96 R; 416/220 R; 415/115

[58] Field of Search ..... 415/115, 116; 416/95, 96 R, 96 A, 97 R, 220 R

[56] References Cited

U.S. PATENT DOCUMENTS

| | | | |
|---|---|---|---|
| 4,453,888 | 6/1984 | Hovan et al. | 416/97 R |
| 5,800,124 | 9/1998 | Zelesky | 416/95 |

FOREIGN PATENT DOCUMENTS

| | | | |
|---|---|---|---|
| 1526683 | 5/1968 | France | 416/220 R |
| 687507 | 2/1953 | United Kingdom | 416/96 R |
| 2057573 | 4/1981 | United Kingdom . | |
| 2095765 | 10/1982 | United Kingdom . | |
| 2262314 | 6/1993 | United Kingdom | 415/115 |
| 2309269 | 7/1997 | United Kingdom . | |

*Primary Examiner*—Christopher Verdier
*Attorney, Agent, or Firm*—W. Warren Taltavull; Farkas & Manelli PLLC

[57] ABSTRACT

A turbine (10) for a gas turbine engine includes an annular array of turbine aerofoil blades (12) which are mounted on a disc (19). Each of the aerofoil blades (12) is provided with a radially inner platform (21). Each platform (21) includes a passage (37) into which leaked cooling air flows. The passages (37) are disposed in a direction having a circumferential component so that cooling air is exhausted from them in a direction that is generally opposite to that in which the disc (19) operationally rotates.

3 Claims, 2 Drawing Sheets

TURBINE

This application is a continuation-in-part of U.S. patent application Ser. No. 08/891,500 filed Jul. 11, 1997, now abandoned.

This invention relates to a turbine and is particularly concerned with minimising the effects of cooling air leakage in a turbine which is air cooled.

It is common practice to provide at least some of the aerofoil blades in the turbine of a gas turbine engine with some form of internal cooling. Typically, that cooling is provided by cool air which has been tapped from the air compression section of the engine. It is important that the cooling air is directed to the interiors of the blades which require cooling, without leaking into regions where it could have an adverse effect upon the overall operating efficiency of the turbine.

One region in which air leakage problems can occur is between turbine discs carrying turbine blades and structures adjacent those discs. Typically, cooling air from the compression section of the gas turbine engine flows along the radially inner regions of the engine before being deflected in radially outward directions between the disc and structure adjacent thereto. The air is then directed into cooling passages provided within turbine blades carried by one of the discs.

Conventionally, in order to inhibit the leakage of cooling air into the hot gas stream which operationally flows over the turbine blades, an annular gas seal is positioned between the disc and the structure adjacent thereto. Typically, the seal is of the labyrinth type comprising annular, axially extending parts provided on both the disc and the adjacent structure which cooperate to define a barrier in the form of a tortuous path for air attempting to flow in a radially outward direction. While such seals are partially effective in providing a barrier to air flowing in radially outward directions, there remains a certain degree of undesirable leakage of cooling air into the hot gas stream.

It is an object of the present invention to provide a turbine in which the deleterious effects of such cooling air leakage into the hot gas stream have upon the overall efficiency of the turbine are reduced.

According to the present invention, a turbine comprises at least one rotatable disc carrying an annular array of aerofoil blades, each of said blades having an aerofoil portion operationally located in an annular gas passage extending through said turbine for the flow of gas through said turbine, means being provided to direct cooling air into passages provided internally of said aerofoil blades to provide cooling thereof, said cooling air operationally flowing, at least partially, in radially outward directions over at least part of the upstream external surface of said disc prior to a part thereof being diverted to provide cooling of said aerofoil blades, means being provided radially inwardly of said aerofoil portions to direct at least some of the remaining cooling air into a region downstream of said disc in a direction having a circumferential component generally opposite to that in which said disc operationally rotates.

Said means to direct at least some of said remaining cooling air into said region downstream of said disc preferably comprises a plurality of passages, each interconnecting said region downstream of said disc with the region upstream of said disc.

Each of said blades is preferably provided with a radially inner platform to define a part of said annular gas passage, in which case one of said passages may be provided within each of said platforms, each passage being so disposed as to direct cooling air exhausted therefrom in said direction having a circumferential component.

A plurality of lock plates may be provided on the downstream side of said disc to provide locking of said blades on said disc, each of said lock plates having an aperture therein which is in communication with one of said passages, deflection means being provided on each of said lockplates and associated with said aperture in said lockplate to deflect cooling air from said passage associated therewith in said direction having a circumferential component.

Each of said deflector means may be in the form of a cowling attached to its associated lockplate.

Each of said blades may be provided with a shank radially inwardly of its aerofoil portion, the shanks of adjacent aerofoil blades being so configured that they cooperate to define said passages.

The present invention will now be described, by way of example, with reference to the accompanying drawings in which.

Figure 1:
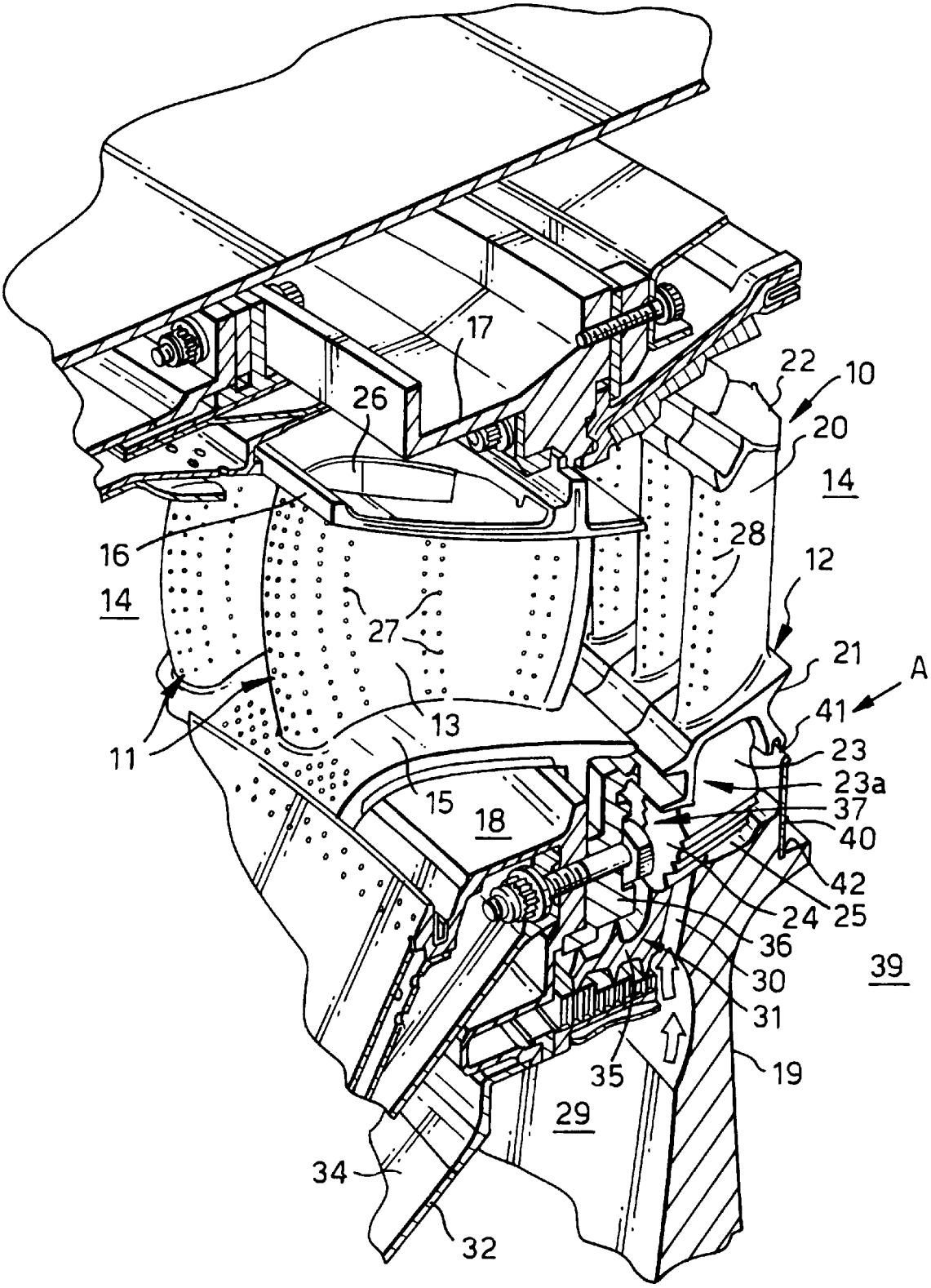
FIG. 1 is a partially broken away perspective view of part of a turbine in accordance with the present invention.

Referring to FIG. 1, a turbine 10 for a gas turbine engines (not shown) is shown in a partial, broken away view. It is of generally conventional configuration comprising an annular array of stator vanes 11 which are located upstream of an annular array of aerofoil rotor blades 12. The turbine 10 is provided with several more axially alternate annular arrays of stator vanes and aerofoil blades, but these have been omitted in the interests of clarity. The stator vanes 11 each comprise an aerofoil portion 13 which is situated in an annular gas passage 14 which extends through the turbine 10. The radially inner and outer extents of the gas passage 14 in the region of the vane aerofoil portions 13 are respectively defined by inner and outer platforms 15 and 16 which are integral with the aerofoil portion 13. The inner platforms 15 of circumferentially adjacent vanes 11 abut to define a generally continuous gas passage-defining surface as do the outer platforms 16.

Each stator vane 11 is respectively supported at its radially inner and outer extents by the turbine casing 17 and an inner support structure 18.

The aerofoil rotor blades 12 are mounted on a common disc 19 which is mounted for rotation within the turbine 10. Each aerofoil rotor blade 12 comprises an aerofoil portion 20 which, like the aerofoil portions 13 of the stator vanes 11, is situated in the annular gas passage 14. Radially inner and outer platforms 21 and 22 respectively on each blade 20 serve to define local portions of the gas passage 14.

Each aerofoil blade 12 is provided with a shank 23 radially inwardly of its inner platform 21 which interconnects the remainder of the blade 12 with a firtree root portion 24. The firtree portion 24 locates in a correspondingly shaped cut-out portion 25 provided in the periphery of the disc 19, thereby providing radial constraint for the aerofoil blade 12. The shanks 23 are circumferentially narrower than their associated firtree root portions 24 so that a circumferential gap 23*a* is defined between adjacent shanks 23.

In order to provide axial constraint of each of the aerofoil blades 12, an annular array of lockplates 40 is provided adjacent their firtree root portions 24. Each lockplate 40 is planar and locates at its radially outer extent in a radially inwardly directed groove 41 defined by its adjacent aerofoil blade 12 and at its radially inner extent in a radially outwardly directed annular groove 42 defined by the disc 19.

The lockplates 40 are well known as such in the construction of turbines.

In operation, extremely hot gases flow through the annular gas passage 14. They act upon the aerofoil portions 20 of the aerofoil blades 12 to bring about the rotation of the turbine disc 19. Since the gases are extremely hot, internal air cooling of the vanes 11 and the aerofoil blades 12 is necessary. Both the vanes 11 and the aerofoil blades 12 are hollow in order to achieve this. In the case of the vanes 11, cooling air derived from a suitable source is directed into their radially outer extents through apertures 26 provided in their radially outer platforms 16. The air then flows through the vanes 11 to exhaust therefrom through a large number of small apertures 27 provided in the vane aerofoil portions 13 into the gas stream flowing through the annular gas passage 14. This provides both convection cooling of the vane 11 interiors and film cooling of their external aerofoil portion 13 surfaces.

Similarly, the aerofoil blades 12 are cooled by a flow of cooling air into their interiors which is exhausted through a large number of small holes 28 in their aerofoil portions 20. However, in this case, the cooling air is directed into the aerofoil blade 12 interiors from their radially inner extents. The air flows in a radially outward direction over the upstream surface 29 of the disc 19 to enter a plurality of generally radially extending passages 30 in the disc 19 periphery. One passage 30 is associated with each firtree root cut-out portion 25 so that a flow of cooling air is directed to the root portion 25 of each of the aerofoil blades 12. A passage (not shown) in each root portion 25 directs cooling air into the blade 12 interior to provide convection cooling of the blade 12. It then flows through the small holes 28 to provide film cooling of the aerofoil portion. The cooling air then mixes with the gases flowing through the annular gas passage 14.

The above mentioned way of air cooling the vanes 11 and aerofoil blades 12 is well known as such.

In order to ensure that cooling air does not by-pass the blade feed passages 30 and prematurely enter the hot gas stream flowing through the annular gas passage 14, an annular seal 31 is provided between the upstream face 29 of the disc 19 and the downstream face 32 of the fixed turbine structure 34 which supports the radially inner extents of the vanes 11. The seal 31 is of the well known labyrinth type comprising a generally axially extending element 35 carried by the disc 19 and a corresponding reception element 36 carried by the fixed turbine support structure 34.

Unfortunately, labyrinth seals such as that described above are not as efficient at providing a barrier to gas flow as would normally be desirable. Consequently, some cooling air inevitably leaks through the labyrinth seal 31 into the region 37 between the firtree root portions 24 and fixed turbine support structure 34. Under normal circumstances, this leaked cooling air would pass into the annular gas passage 14 and have a prejudicial effect upon the gases operationally flowing through that passage 14. However, in accordance with the present invention, the leaked cooling air is utilised in a more effective and efficient manner.

Figure 2:
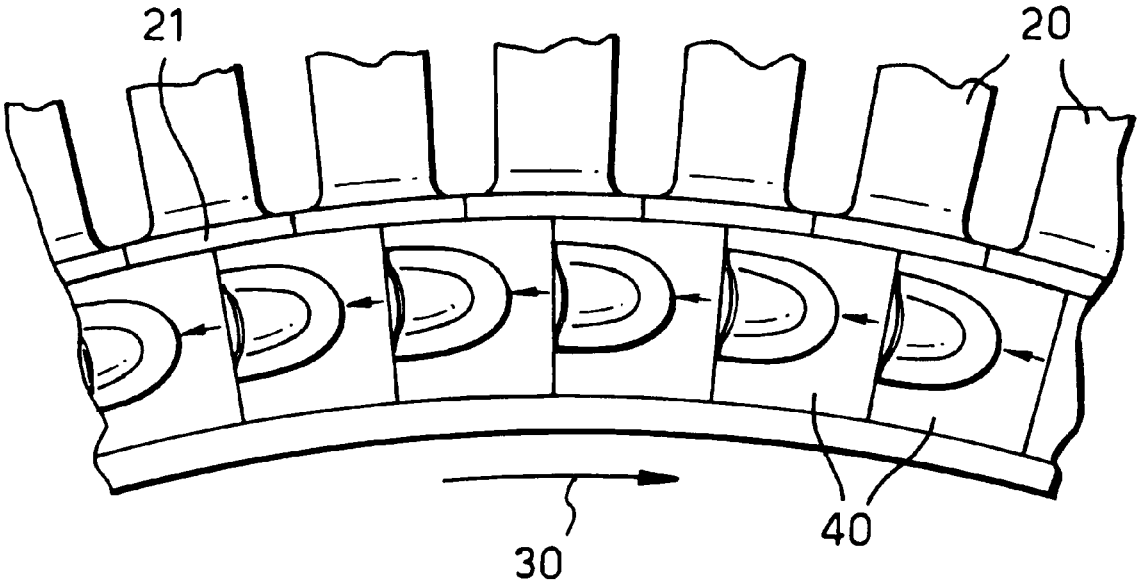
FIG. 2 is a view similar to that shown in FIG. 1 of an alternative embodiment of the present invention.
Figure 3:
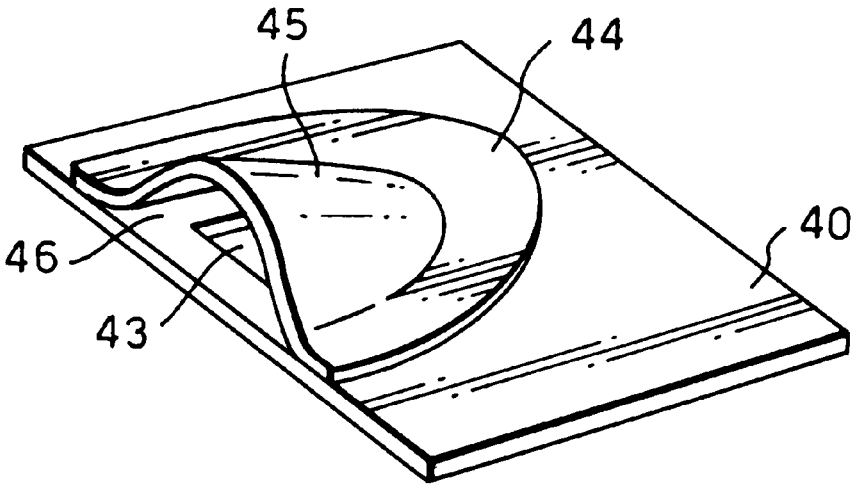
FIG. 3 is a perspective view of a portion of the embodiment shown in FIG. 2.

It is not essential that the cooling air is exhausted from the passages 37 in order to provide the desired improvement in turbine efficiency. If reference is now made to FIGS. 2 and 3, similar improvements may be achieved by the deletion of the passages 37 and the modification of lockplates 40. More specifically, each of the lockplates, which in modified form as depicted in FIGS. 2 and 3, is designated 40, is provided with an aperture 43. Each aperture 43 is partially enclosed by a cowling 44 which is bonded to its associated lockplate 40 and is of part-oval configuration in plan view. The centre portion 45 of each cowling 44 is raised so as to define an outlet 46 adjacent one edge of its associated lockplate 40.

In operation, cooling air from the region 37 flows through the gaps 23*a* between the blade shanks 23 as described earlier. However, that cooling air then flows through the apertures 43 in the lockplates 40. Each cowling 44 is so configured that the cooling air flow is deflected in a generally circumferential direction which is opposite to the direction of rotation 39 of the disc 19. Consequently, the deflected airflow serves the same function as the airflow exhausted from the passages 37 in improving overall turbine efficiency.

I claim:

1. A turbine comprising at least one rotatable disc carrying an annular array of aerofoil blades, each of said blades having an aerofoil portion operationally located in an annular gas passage extending through said turbine for flow of gas through said turbine, means being provided to direct cooling air into passages provided internally of said aerofoil blades to provide cooling thereof, said cooling air operationally flowing, at least partially, in radially outward directions over at least part of the upstream external surface of said at least one disc prior to a part of said cooling air being diverted to provide cooling of said aerofoil blades, a plurality of lock plates being provided on the downstream side of said at least one disc to provide locking at said blades on said at least one disc, means being provided radially inwardly of said aerofoil portions to direct at least some of the remaining cooling air towards said lock plates, each of said lock plates having an aperture therein, deflection means being provided on each of said respective lockplates and associated with each respective aperture in each said respective lockplate to deflect said cooling air directed towards said lock plates into a region downstream of said at least one disc in a direction having a circumferential component generally opposite to that in which said at least one disc operationally rotates.

2. A turbine as claimed in claim 1 wherein each of said aerofoil blades is provided with a shank radially inwardly of its aerofoil portion, said means to direct at least some of said remaining cooling air towards said lock plates comprising a plurality of passages, defined by the shanks of said aerofoil blade.

3. A turbine as claimed in claim 1 wherein each of said deflector means is in the form of a cowling attached to its associated lockplate.

* * * * *